US008020535B2

(12) United States Patent
Law

(10) Patent No.: US 8,020,535 B2
(45) Date of Patent: Sep. 20, 2011

(54) ACCESSORY FOR A FUEL BURNING OR PROCESSING ENGINE OR MACHINE

(76) Inventor: Seng Teck Law, Singapore (MY)

( * ) Notice: Subject to any disclaimer, the term of this patent is extended or adjusted under 35 U.S.C. 154(b) by 851 days.

(21) Appl. No.: 10/588,828

(22) PCT Filed: Feb. 9, 2004

(86) PCT No.: PCT/SG2004/000033

§ 371 (c)(1),
(2), (4) Date: Apr. 4, 2007

(87) PCT Pub. No.: WO2005/076423

PCT Pub. Date: Aug. 18, 2005

(65) Prior Publication Data

US 2007/0278923 A1 Dec. 6, 2007

(51) Int. Cl.
*F02P 9/00* (2006.01)

(52) U.S. Cl. ..... 123/538; 123/169 R

(58) Field of Classification Search ..... 123/536–538, 123/169 R–169 V

See application file for complete search history.

(56) References Cited

U.S. PATENT DOCUMENTS

| | | | | | |
|---|---|---|---|---|---|
| 2,686,509 | A | * | 8/1954 | Drinkard | 123/143 C |
| 3,613,653 | A | * | 10/1971 | Irvin et al. | 123/146.5 A |
| 4,269,160 | A | * | 5/1981 | Irvin, Jr. | 123/620 |
| 4,327,702 | A | | 5/1982 | Imai et al. | |
| 5,044,346 | A | * | 9/1991 | Tada et al. | 123/536 |
| 5,159,915 | A | * | 11/1992 | Saito et al. | 123/557 |
| 5,671,719 | A | * | 9/1997 | Jeong | 123/538 |
| 5,934,228 | A | * | 8/1999 | Wheat | 123/48 C |
| 2005/0011500 | A1 | * | 1/2005 | Allen | 123/537 |

FOREIGN PATENT DOCUMENTS

| | | |
|---|---|---|
| GB | 2129603 | 5/1984 |
| JP | 59138010 | 8/1984 |

* cited by examiner

*Primary Examiner* — M. McMahon
(74) *Attorney, Agent, or Firm* — Bachman & LaPointe, P.C.

(57) ABSTRACT

An accessory for a fuel burning or processing engine or machine is provided. The accessory comprises a core formed of a material having ferri-magnetic properties. The core is of elongate form and defines a recess adapted to receive a high tension lead. The accessory further comprises a clamping device for clamping the high tension lead and retain it in the recess. The core is retained within a housing formed of a non-ferrous material. The housing is provided with a device for receiving calibrating elements formed of a material with high magnetic permeability at low field strength and low hysteresis loss.

6 Claims, 5 Drawing Sheets

ACCESSORY FOR A FUEL BURNING OR PROCESSING ENGINE OR MACHINE

FIELD OF THE INVENTION

THE PRESENT INVENTION relates to an accessory for a fuel burning or processing engine or machine and, more particularly, relates to an accessory for an internal combustion engine provided with one or more spark plugs which are connected to a source of high tension electricity by means of high tension cables.

BACKGROUND

Fuel burning engines may operate on a number of different fuels including hydrogen, a simple hydrocarbon such as methane or propane, or a more complicated hydrocarbon such as petrol.

It is desirable to enhance the operating characteristics of a fuel burning or processing engine or machine regardless of the fuel that is used.

SUMMARY OF THE INVENTION

According to one aspect of this invention there is provided an accessory for a fuel burning or processing engine or machine, the accessory comprising a core formed of a material having ferri-magnetic properties, the core being of elongate form and defining a recess adapted to receive a high tension lead, there being clamping means adapted to clamp a high tension lead and retain it in the recess, wherein the core is retained within a housing formed of a non-ferrous material and the housing is provided with means adapted to receive calibrating elements formed of a material with high magnetic permeability at low field strength and low hysteresis loss.

Preferably the core is formed of a material having high resistivity and low reluctance.

Conveniently the core is formed of ferrite.

Advantageously the housing has a lower housing element, and an upper cover pivotally connected to the lower housing element.

Conveniently the calibrating elements are formed of permalloy.

Preferably an inner part of the housing is provided with a plurality of spaced apart pegs, and the calibrating elements are each provided with two apertures adapted to be engaged with two spaced apart pegs.

Conveniently the clamping means comprise a clamping plate formed of a non-ferrous material.

Advantageously the clamping plate is formed of copper, copper alloy, aluminium or aluminium alloy.

Preferably parts of the clamping plate are adapted to be snapped-off.

Advantageously the accessory further comprises at least one groupings setter comprising an element defining at least one aperture adapted selectively to receive a ferrite insert.

Conveniently four dynamic groupings setters are provided.

According to another aspect of this invention there is provided a method of energising fuel comprising hydrogen or a hydrogen compound used in a fuel burning or processing engine or machine, the method comprising the step of providing a core formed of a material exhibiting ferri-magnetic properties, the core defining a channel adapted to receive a high tension lead of the engine or machine, locating the core in position with the high tension lead received in the channel, and retaining the core and the high tension lead with that relative positioning whilst operating the engine or machine.

Advantageously, the engine or machine is an internal combustion engine and the high tension lead is a spark plug lead.

BRIEF DESCRIPTION OF THE DRAWINGS

In order that the invention may be more readily understood, and so that further features thereof may be appreciated, the invention will now be described, by way of example, with reference to the accompanying drawings in which.

DETAILED DESCRIPTION OF THE PREFERRED EMBODIMENTS

Figure 1:
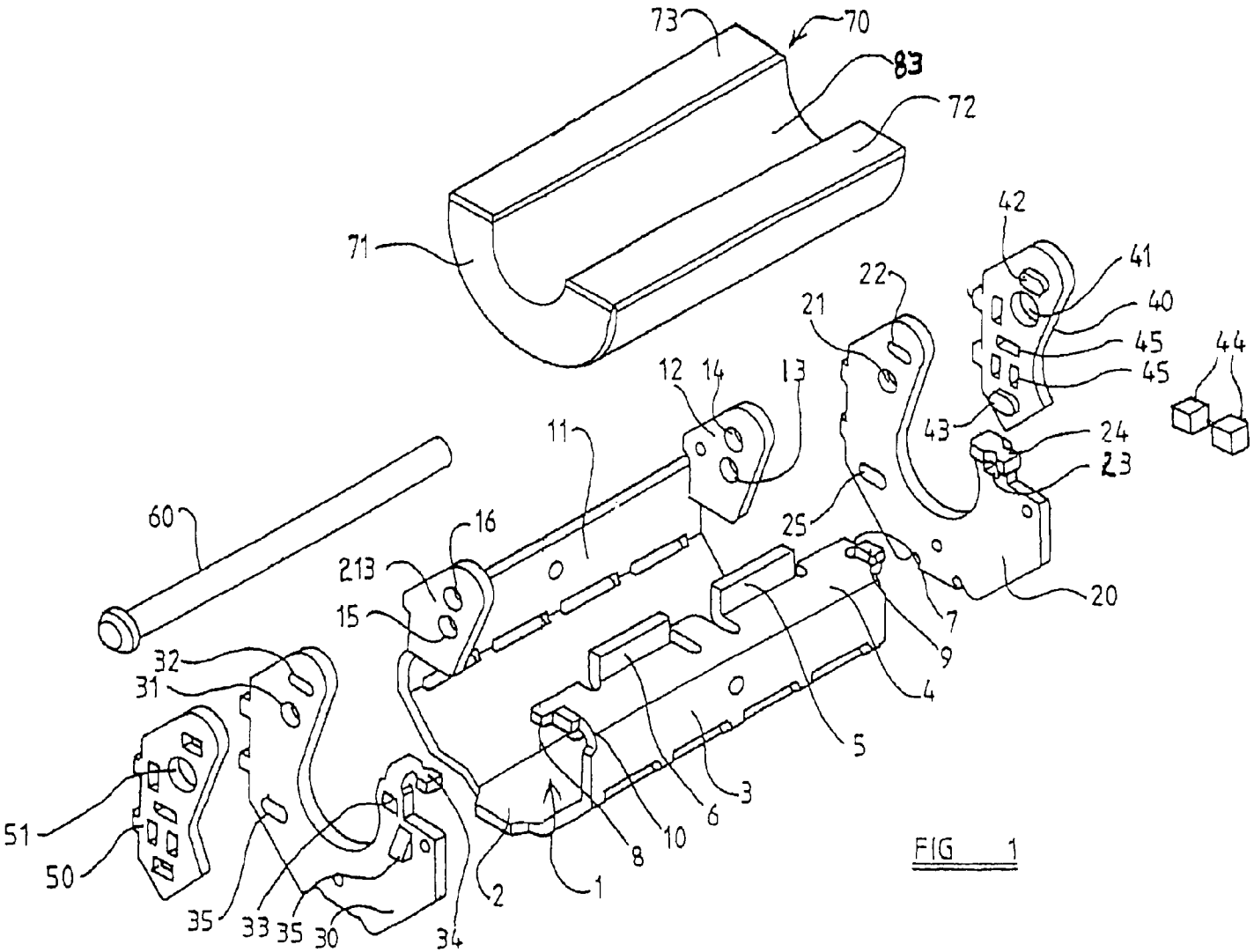
FIG. 1 is an exploded view of some components of an accessory in accordance with the invention.

Referring initially to FIG. 1 of the accompanying drawings, an accessory in accordance with the invention is provided with a lower housing element 1. The lower housing element 1 is of elongate form, and defines a base 2 which supports an upstanding front wall 3 carrying an inwardly directed lip 4 which extends inwardly over the base 2. The inward edge of the lip 4 carries two spaced apart upwardly directed lugs 5, 6. At each end of the lip 4 there is provided an axially extending projection 7, 8 and an adjacent upwardly extending abutment 9, 10.

The base 2 also supports an upwardly directed rear wall 11, the rear wall 11, carrying, adjacent the upper edge thereof and at each end thereof, a forwardly directed vertical lug 12, 13. The lugs extend inwardly over the base 2.

The lug 12 defines an aperture 13 and, at a position above the aperture 13, a projecting pip 14. The pip projects in a direction away from the rest of the lower housing element 1. The forwardly directed lug 213 defines an aperture 15 and, above the aperture 15, an outwardly directed pip 16 which is directed outwardly away from the rest of the lower housing element 1. It is to be appreciated, therefore, that the lower housing element 2 is in the form of a substantially channel-shaped element.

At a first end of the lower housing element 1 is a housing end plate 20. The outer periphery of the end plate has a configuration equivalent to the configuration of the cross-section of the channel defined by the lower housing element 1. The end plate 20 is configured to be abutted against the end of the lower housing element 1, and has an aperture 21 adapted to be aligned with the aperture 13 formed in the forwardly directed lug 2 and, at a position above the aperture 21, a further aperture 22 dimensioned to accommodate part of the pip 14.

The part of the end plate 20 which lies adjacent the projection 7 and the abutment 10 is provided with an aperture 23 dimensioned to receive the projection 7, and a locking tab 24 adapted lockingly to engage with the abutment 9.

The end piece 20 is provided with a further aperture 25 located at a position spaced beneath the aperture 21.

At the other end of the lower housing element, a corresponding end plate 30 is provided having apertures 31, 32 and 35 corresponding to the apertures 21, 22 and 25 described above, and also having an aperture 33 and locking tab 34 corresponding to the aperture 23 and locking tab 24 described above. As can be seen in FIG. 1, the outer-most end plate 30 is provided with a snap-action projection 35. The projection has an upper inclined or ramped face and a lower horizontal face. The end plate 20 is provided with a corresponding projection, but this is not visible in FIG. 1.

The lower housing element 1 and the end plates 20 and 30 are formed of a non-ferrous metal such as aluminium or some other non-ferrous material such as high temperature silicone rubber. The end plates are mounted on the lower housing element 1 to form the lower part of a complete housing.

At one end of the housing, a groupings setter 40 is provided. The grouping setter 40 is in the form of a plate adapted to be located adjacent the end plate 20. The setter 40 defines an aperture 41 to be aligned with the aperture 22, and defines a protruding boss 42 adapted to receive within the aperture 22 and a further protruding boss 43 adapted to be received within the aperture 25.

The groupings setter 40 is provided with a plurality of further apertures 45, which in this embodiment is shown as being of generally rectangular form, the apertures being dimensioned to receive ferrite bits 46 which are each dimensioned to be received as a friction fit within an aperture 45.

At the other end of the housing a corresponding groupings setter 50 is provided having similar features which will not be re-described at this stage.

A connecting axle 60 is provided adapted to be received through the co-aligned apertures 51, 31, 15, 13, 21 and 41 to secure the above described elements together. As will become clear from the following description, additional components are mounted on the part of the axle 60 located between the lugs 12 and 16.

Received within the lower housing element 1 is a core 70 formed of a magnetic material, presenting ferri-magnetic properties such as, for example, a ferrite material, that is to say a material presenting high resistivity and low reluctance. Ferrite is a ceramic ionoxide compound having ferromagnetic properties which has the general formula $MOFe_2O_3$ where M is generally a metal such a cobalt nickel or zinc. Thus the ferrite may incorporate a bivalent or polyvalent metal. The ferrite is sintered to have a predetermined shape. The core 70, of the described embodiment, has a semi-annular cross-section. The exterior 71 of the core is dimensioned so that the core can be received within the lower housing element 1. The core defines two planar upper faces 72, 73. One planar face is adapted to be received beneath the inwardly directed lip 4 and the other face 73 is intended to be located beneath the lower-most edge of the inwardly directed lugs 12 and 13. The central part of the core defines an axially extending channel 83 of semi-circular form, and this channel is dimensioned snugly to receive a high tension cable, such as a high tension cable extending to a spark plug of an internal combustion engine.

Figure 2:
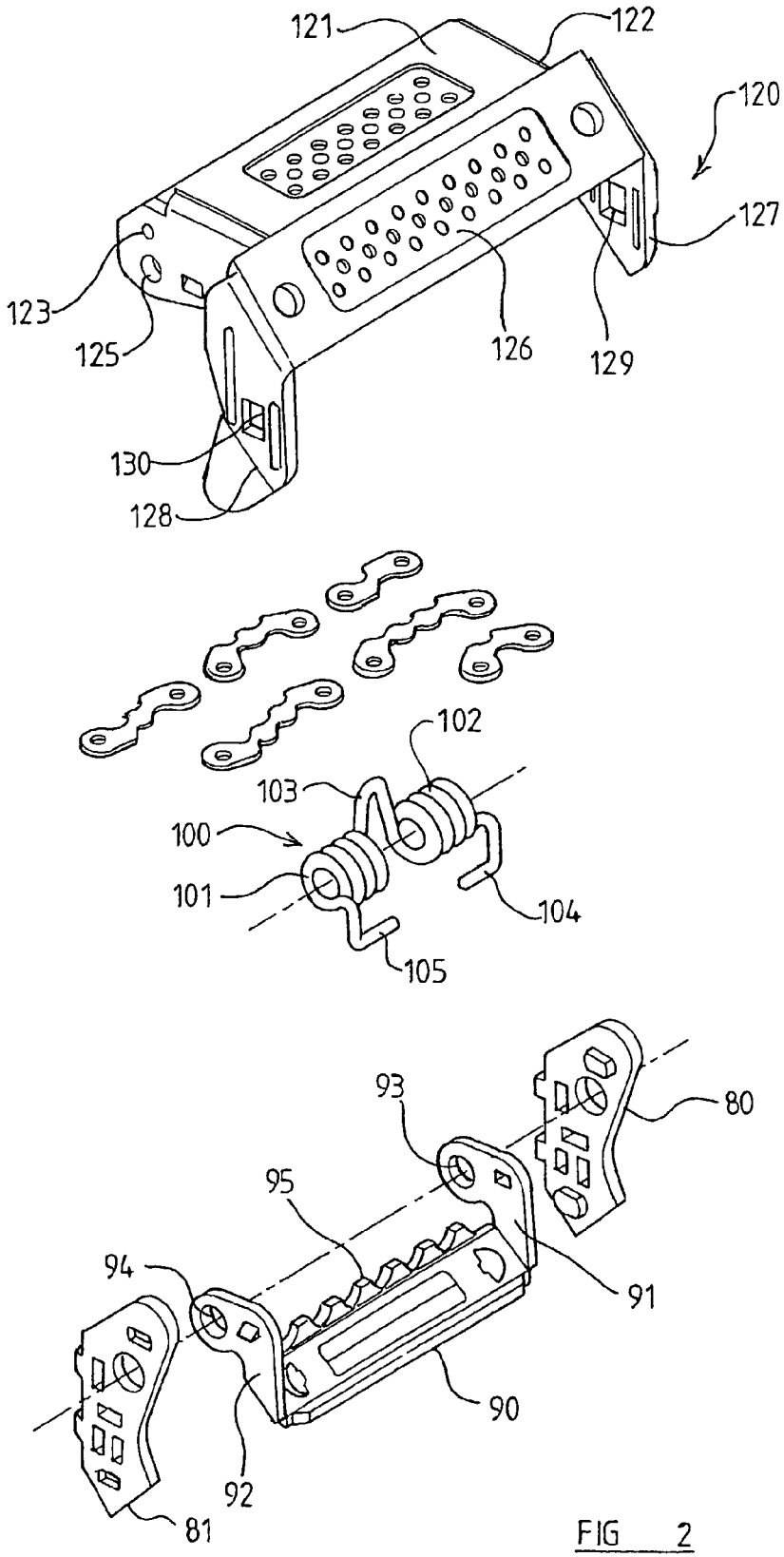
FIG. 2 is an exploded view of further components of an embodiment of the invention which are combined with the components of FIG. 1.

Turning now to FIG. 2, further elements of an accessory in accordance with the invention will now be described.

Two further groupings setters 80, 81 are shown, each having a configuration identical to that of the grouping setters 40 and 50 as described above. These groupings setters are also adapted to receive ferrite inserts and are positioned to be located adjacent the inner faces of the inwardly directed lugs 12 and 13. Mounted between the groupings setters 80, 81 is a pivotally mounted plate 90. The plate 90 is an elongate plate having, at each end thereof, an upstanding cranked arm 91, 92, each of which defines an aperture 93, 94 to receive part of the axle 60. One edge of the plate 90 is provided with snap-off elements 95 in the form of castellations. These elements may be snapped off selectively. The plate is formed of a non-ferrous material, such as copper, copper alloy, aluminium or aluminium alloy.

A clamping spring 100 is provided comprising two helical coils 101, 102 inter-connected by a radially outwardly directed bridging piece 103. The ends of the coils are provided with inwardly and axially directed fingers 104, 105. The spring 100 is adapted to receive the axle 60 through the co-aligned helical coils 101, 102. The radially directed bridging piece extending extension 103 is adapted to abut against part of the rear wall 11 of the lower housing element and the inwardly directed fingers 104 and 105 are adapted to engage the cranked arms 91 and 92 to impart a rotational bias to the pivotally mounted plate 90. As will be described hereinafter, the pivotally mounted plate serves to clampingly engage a high tension cable and retain the high tension cable within the channel 73 defined by the core 70, thus securing the core to the high tension cable.

Figure 3:
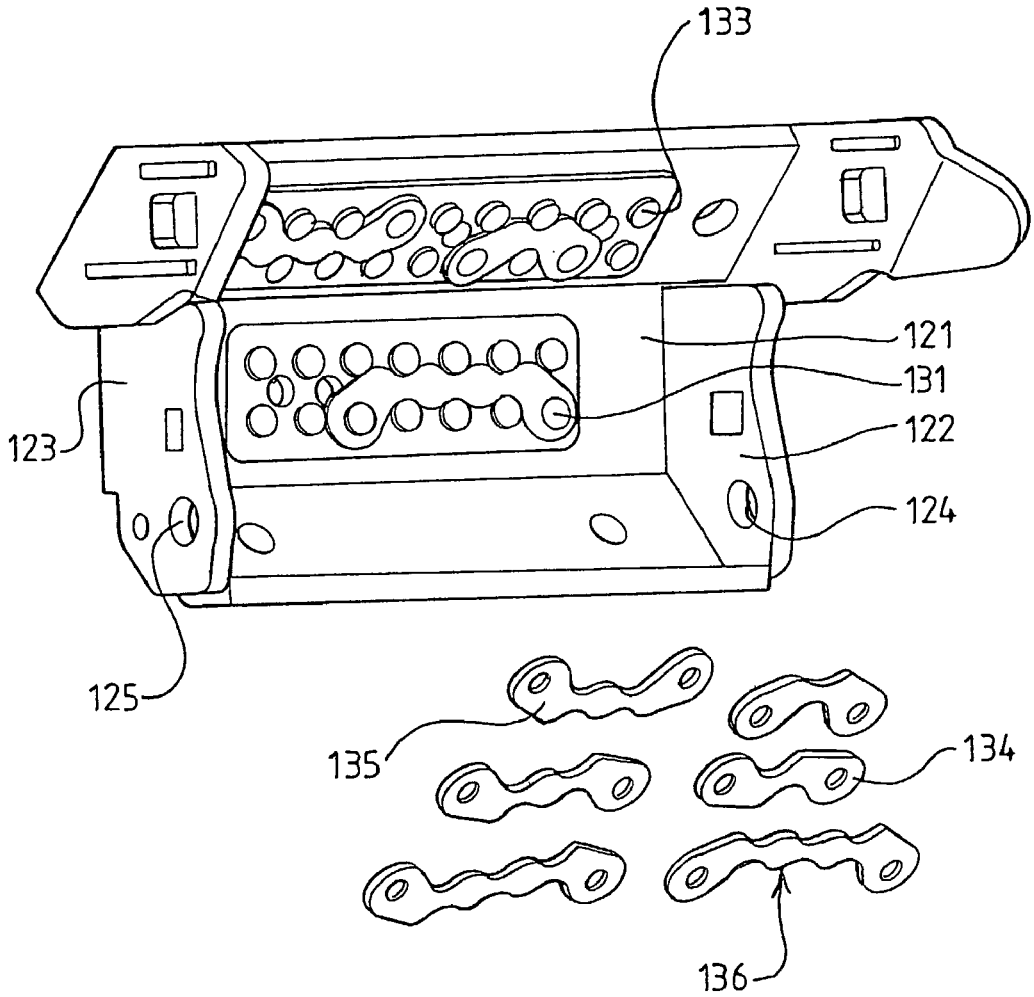
FIG. 3 is a view of some of the components shown in FIG. 2, viewed from a different perspective, for the purposes of explanation.

A cover 120 is provided, the cover being illustrated in FIG. 2 and also in FIG. 3. The cover comprises an upper plate 121 which has, at each edge thereof, a depending wall 122, 123. The wall 122 defines an aperture 124 to accommodate the axle 60 and the depending wall 123 defines an equivalent aperture 125. When the cover is mounted on the axle 60 it is pivotable relative to the rest of the housing between open and closed positions.

The forward edge of the top plate 121 carries an inclined plate 126, the inclined plate having a slightly greater width than the upper plate 122. At each end of the inclined plate 126 there is a downwardly extending, slightly resilient snap-acting lug 127, 128. The snap-acting lug 127 defines an aperture 129, and the snap-acting lug 128 defines an aperture 130.

As will become clear, from the following description, the cover, 120, may be moved to a closed position, with the snap-acting lugs 127 and 128 moving such that the apertures 129 and 130 are brought into engagement with the snap-action abutments 25 and 35 provided on the end plates 20 and 30 associated with the lower housing element 1.

Figure 4A:
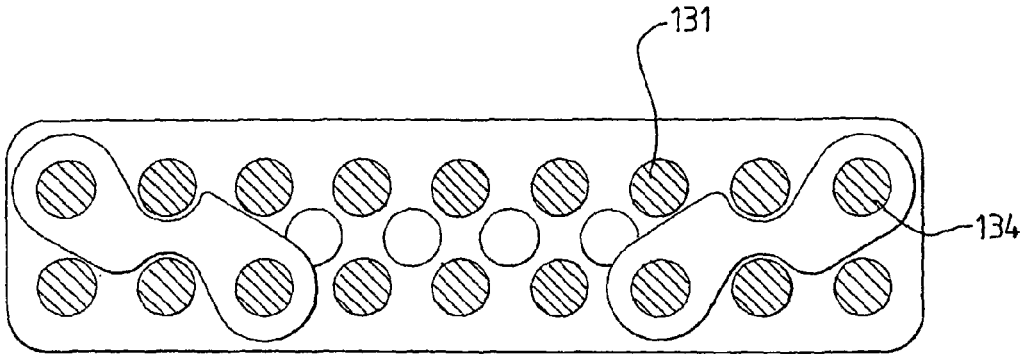
FIGS. 4A, 4B and 4C are views of part of one of the components of FIG. 3 in different configurations.
Figure 4B:
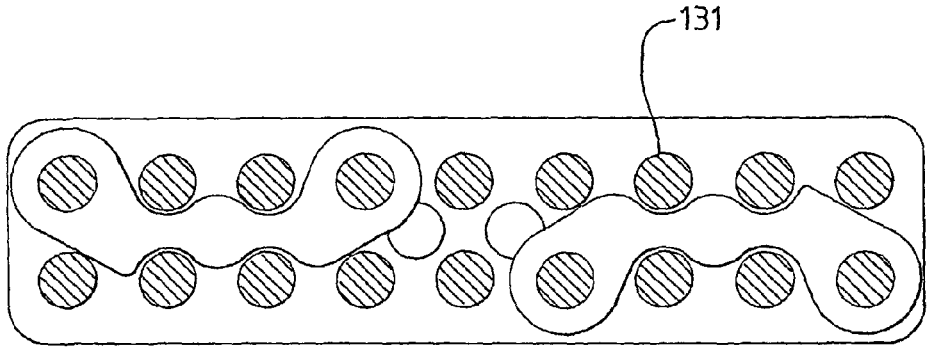
Figure 4C:
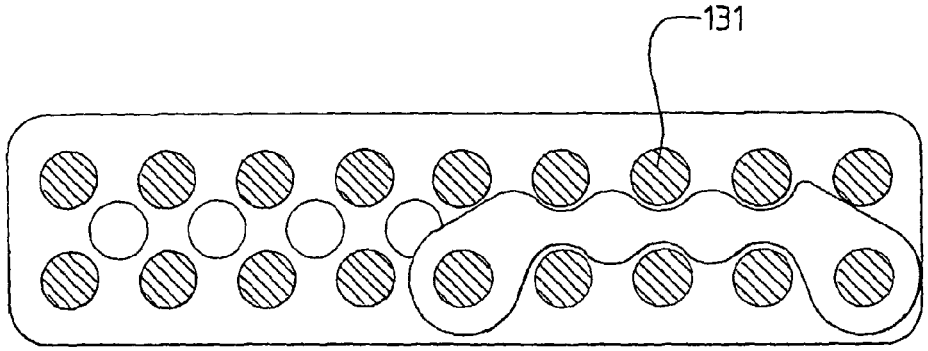

The under-side of the top plate 121 is provided with a plurality of spaced apart pegs 131 forming a regular array of pegs. The under-side of the inclined peg 126 is also provided with a corresponding plurality of evenly spaced pegs 133. FIG. 4 shows the array of pegs 131, but the array of pegs 133 is identical.

A plurality of balancing elements 134, 135, 136 are provided. The balancing elements are of different designs. As can be seen more clearly from FIGS. 4A, 4B and 4C each balancing element 134, 135, 136 is of generally elongate form having an aperture at each end thereof, the apertures of each element being spaced apart by a distance equal to the spacing between the two pegs, and having a diameter substantially equal to the diameter of a peg, the intermediate part of each element being so configured that the element may be snapped into position by aligning the apertures at each end of the element with two pegs, and pressing the element into place. Some examples of balance elements have been illustrated, but other designs of balancing element may be used. The balancing elements are formed of a material having a high magnetic permeability at low field strength and preferably a low hysteresis loss. A typical material that may be used is permalloy. The cover, on the other hand, is formed of a non-ferrous metal such as aluminium, or some other non-ferrous material such as high temperature silicone rubber.

Figure 5:
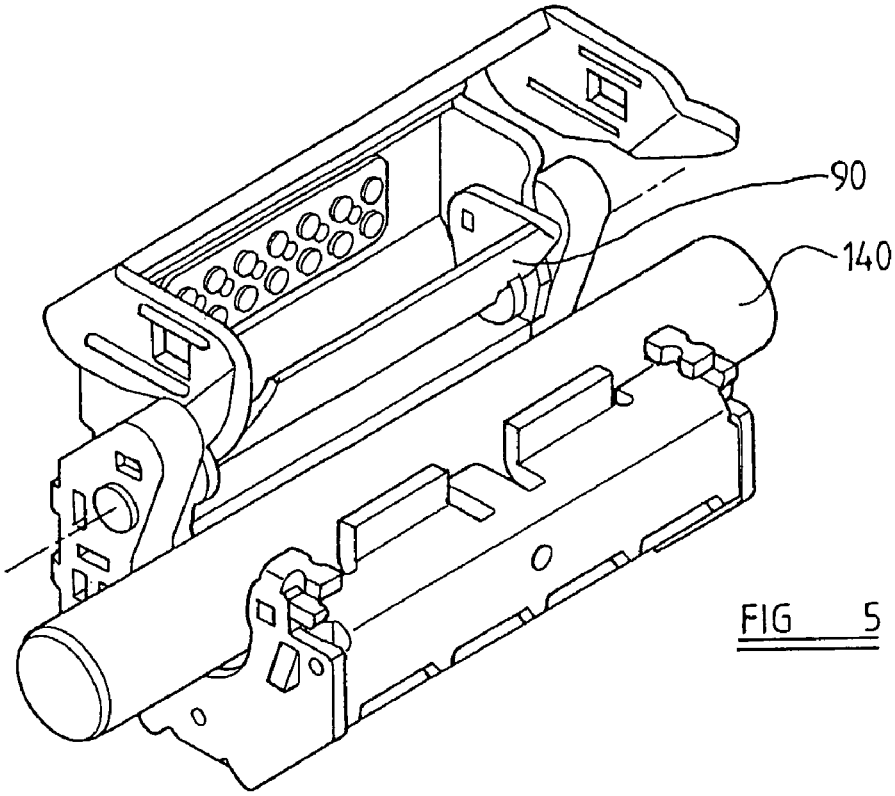
FIG. 5 is a view showing the components of FIGS. 1 and 2 when assembled.
Figure 6:
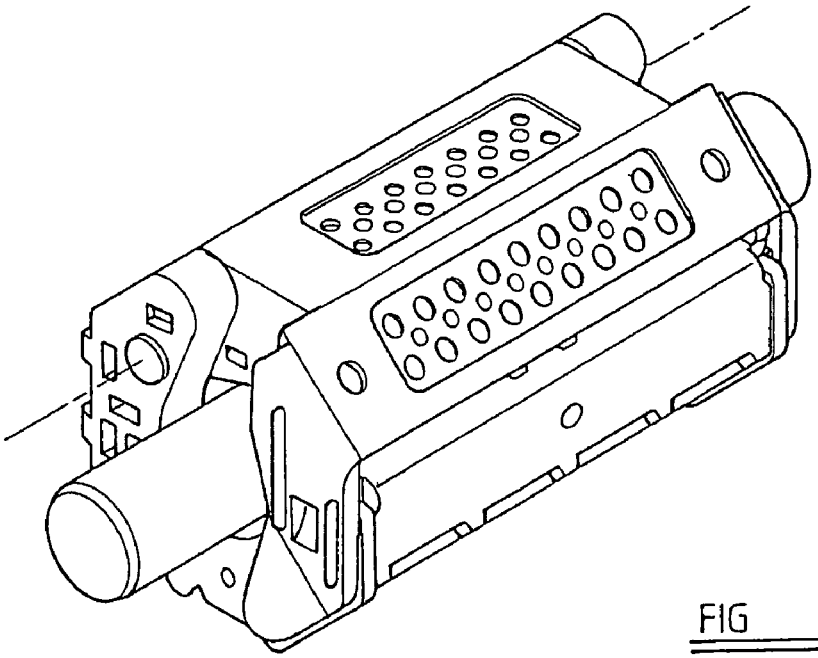
FIG. 6 is a view showing the accessory connected to a high tension cable.

FIG. 5 illustrates the various components of FIGS. 1, 2 and 3 when assembled together, and showing a high tension cable 140 in position within the channel 73. The plate 90 is shown in an elevated position and is retained in that position against the biasing force applied thereto by the spring 100. When the plate is released, the plate will serve to clamp the high tension cable 140 in position within the core 70. The cover may then be moved to the closed position. The accessory will then have the condition illustrated in FIG. 5.

It has been found that when an accessory as described above is mounted on a high tension cable such as a high tension cable leads to the spark plugs of an internal combustion engine, improved engine efficiency is obtained.

Whilst not wishing to be bound by the following explanation, it is believed that the core 70, which is made of a material exhibiting ferri-magnetic properties, such as a ferrite material, is located within a high energy electric field created when the successive pulses of electricity flow through the high tension cable, as the spark plug sparks. Subsequently a high energy electromagnetic field radiates from the core. This high energy field acts on the fuel.

It is believed that hydrocarbon fuel presents a basic "cage-like" structure when viewed at the molecular level. Each molecule of hydrocarbon comprises a central "spine" formed of carbon atoms, which is shrouded with the hydrogen atoms carried by the carbon spine. Consequently it is believed that oxidation of the carbon is hindered by the molecular structure of the hydrocarbon molecules. Furthermore it is believed that hydrocarbon molecules bind into larger groups of molecules in the form of "pseudo compounds". Such groups associate to form clusters. This further inhibits the access of oxygen in the right quantity, to the interior of such groups of molecules. It is believed that the magnetic field energises the hydrocarbons, breaking up such associations.

If the fuel is hydrogen, it is to be understood that an atom of hydrogen consists of one proton, carrying a positive charge and one electron carrying a negative charge, and therefore possesses a dipole moment. The atom can be either diamagnetic or paramagnetic (weaker or stronger response to the magnetic flux) depending upon the relative orientation of its spins. Thus, even though it is the simplest of all elements, it is believed to occur in two distinct isomeric varieties, characterised by the different opposite nuclear spins and termed "para" and "ortho". Thus, in a para-hydrogen molecule, which has two hydrogen atoms, the spin state of one atom relative to another is in the opposite direction, rendering it diamagnetic. On the other hand, in the ortho molecule, the spins are parallel, with the same orientation for the two atoms. Such a molecule is paramagnetic. It is believed that para-hydrogen can be converted to the higher energy ortho-hydrogen by magnetic stimulation, and thus it is believed that the magnetic field generated by the accessory of the invention converts at least a portion of the hydrogen fuel to the more highly energised ortho-hydrogen state.

A similar effect is found if a hydro-carbon gas, such as methane or propane is utilised, in that the magnetic field serves to energise the molecules of gas.

In the described embodiment, it is possible to effect various adjustments or calibrations to the described accessory. The adjustments or calibrations may be made on a trial or error basis, or may be predetermined depending upon certain characteristics or parameters of the engine in connection with which the accessory is to be used.

A first stage of adjusting or calibrating the accessory may be by adjusting the pivotally mounted plate 90 which can be considered to be a balancing plate. Some of the snap-off projections or castellations 95 provided on the plate 90 may be broken away to improve the harnessing effect. A further adjustment may be made by selectively introducing the inserts 134 into the top cover 120. The inserts are positioned to achieve optimum harnessing of the scattering effect.

The final adjustment that may be made is achieved by selectively inserting ferrite elements into the apertures provided for that purpose in the groupings setters 40, 50, 80 and 90.

While the invention has been described with reference to the use of the described accessory on the high tension lead leading to the spark plugs of an internal combustion engine it is to be appreciated that the accessory may be used with other types of engine or machine which burn or process hydrogen-containing fuel, such as hydrogen or a hydrocarbon. For example the accessory may be used with a diesel engine. If the accessory is to be used with a diesel engine a high tension lead carrying a varying electric current needs to be provided on which the accessory is to be mounted. Also an accessory as described may be used with other engines or machines which burn or process hydrogen-containing fuel such as, for example, a turbine or any other fuel burning engine, such as an engine used in a power plant, or any other machine which burns or processes hydrogen compounds.

In the present specification "comprise" means "includes or consists of" and "comprising" means "including or consisting of".

The features disclosed in the foregoing description, or the following Claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method comprising the steps of:

providing a core formed of a material exhibiting ferri-magnetic properties and having a semi-annular cross-section, the core defining a channel adapted to directly receive a high tension lead of an engine or machine, locating at least part of the high tension lead in the channel, retaining the core and the high tension lead in a position with respect to each other, and applying electricity to the high tension lead to generate an electromagnetic field in the core which radiates from the core to act on a fuel in the engine or machine and to generate a spark for burning the fuel in the engine or machine.

2. A method according to claim 1, wherein the method further comprises providing a housing including a lower housing element, and an upper cover pivotally connected to the lower housing element, and the core is positioned within the housing.

3. A method according to claim 1, wherein the engine or machine is an internal combustion engine and the high tension lead is a spark plug lead.

4. A method according to claim 2 wherein the housing is provided with a plurality of spaced apart pegs and at least one balancing element is mounted on the housing at the pegs.

5. A method according to claim 4 wherein the housing is formed of a non-ferrous material.

6. A method according to claim 5 wherein the at least one balancing element is formed of permalloy.

* * * * *